US007963667B2

(12) United States Patent
Thurgood et al.

(10) Patent No.: US 7,963,667 B2
(45) Date of Patent: Jun. 21, 2011

(54) LED LIGHTING DEVICE

(76) Inventors: Stan Thurgood, Hooper, UT (US); Jim Malfitano, Newburyport, MA (US); Lijian Geng, Holliday, UT (US)

( * ) Notice: Subject to any disclaimer, the term of this patent is extended or adjusted under 35 U.S.C. 154(b) by 0 days.

(21) Appl. No.: 12/731,939

(22) Filed: Mar. 25, 2010

(65) Prior Publication Data

US 2010/0187964 A1 Jul. 29, 2010

Related U.S. Application Data

(63) Continuation of application No. 12/113,929, filed on May 1, 2008, now abandoned.

(51) Int. Cl.
*F21V 1/00* (2006.01)

(52) U.S. Cl. ..... 362/238; 362/294; 362/373

(58) Field of Classification Search ..... 362/294, 362/373, 235–238

See application file for complete search history.

(56) References Cited

U.S. PATENT DOCUMENTS

| | | | |
|---|---|---|---|
| 1,151,377 | A | 8/1915 | Nash |
| 4,240,090 | A | 12/1980 | Hughes |
| 4,394,679 | A | 7/1983 | Hawrylo |
| 4,674,011 | A | 6/1987 | Patton |
| 4,675,575 | A | 6/1987 | Smith |
| 4,727,289 | A | 2/1988 | Uchida |
| 5,055,892 | A | 10/1991 | Gardner |
| 5,160,200 | A | 11/1992 | Cheselske |
| 5,174,646 | A | 12/1992 | Siminovitch |
| 5,349,599 | A | 9/1994 | Larkins |
| 5,414,281 | A | 5/1995 | Watabe |
| 5,463,280 | A | 10/1995 | Johnson |
| 5,535,230 | A | 7/1996 | Abe |
| 5,575,459 | A | 11/1996 | Anderson |
| 5,595,438 | A | 1/1997 | Burd |
| 5,655,830 | A | 8/1997 | Ruskouski |
| 5,688,042 | A | 11/1997 | Madadi |
| 5,707,139 | A | 1/1998 | Haitz |
| 5,721,430 | A | 2/1998 | Wond |
| 5,758,951 | A | 6/1998 | Haitz |
| 5,765,940 | A | 6/1998 | Levy |
| 5,803,579 | A | 9/1998 | Turnbull |
| 5,806,965 | A | 9/1998 | Deese |
| 5,813,752 | A | 9/1998 | Singer |
| 5,890,794 | A | 4/1999 | Abtahi |
| 5,941,626 | A | 8/1999 | Yamuro |
| 5,941,631 | A | 8/1999 | Hsu |
| 5,947,588 | A | 9/1999 | Huang |
| 5,982,092 | A | 11/1999 | Chen |
| 6,015,979 | A | 1/2000 | Sugiura |
| 6,045,240 | A | 4/2000 | Hochstein |
| 6,149,283 | A | 11/2000 | Conway |
| 6,220,722 | B1 | 4/2001 | Begemann |
| 6,238,077 | B1 | 5/2001 | Ramer |
| 6,355,946 | B1 | 3/2002 | Ishinaga |

(Continued)

OTHER PUBLICATIONS

US Pending Patent Application, U.S. Appl. No. 12/785,203, Office Action dated Nov. 2, 2010.

(Continued)

*Primary Examiner* — Julie A Shallenberger

(57) ABSTRACT

The present invention is a light generation device utilizing higher efficiency LED's while also allowing for interface with current lighting interfaces. The LED's are replaceable in the unit and may be interchanged with other LED's to affect lighting mood and style or simply for replacement in the event an LED ceases to function.

17 Claims, 5 Drawing Sheets

U.S. PATENT DOCUMENTS

| | | | | |
|---|---|---|---|---|
| 6,357,889 | B1 | 3/2002 | Duggal | |
| 6,402,338 | B1 | 6/2002 | Mitzel | |
| 6,412,971 | B1 | 7/2002 | Wojnarowski | |
| 6,478,453 | B2 | 11/2002 | Lammers | |
| 6,499,860 | B2 | 12/2002 | Begemann | |
| 6,502,952 | B1 | 1/2003 | Hartley | |
| 6,504,180 | B1 | 1/2003 | Hermans | |
| 6,541,800 | B2 | 4/2003 | Barnett | |
| 6,561,680 | B1 | 5/2003 | Shih | |
| 6,577,073 | B2 | 6/2003 | Shimizu | |
| 6,580,228 | B1 | 6/2003 | Chen | |
| 6,601,962 | B1 | 8/2003 | Ehara | |
| 6,635,987 | B1 | 10/2003 | Wojnarowski | |
| 6,709,132 | B2 | 3/2004 | Ishibashi | |
| 6,715,900 | B2 | 4/2004 | Zhang | |
| 6,786,625 | B2 | 9/2004 | Wesson | |
| 6,815,241 | B2 | 11/2004 | Wang | |
| 6,840,654 | B2 | 1/2005 | Guerrieri | |
| 6,903,380 | B2 | 6/2005 | Barnett | |
| 6,948,829 | B2 | 9/2005 | Verdes | |
| 6,974,233 | B1 * | 12/2005 | Aubrey | 362/294 |
| 6,982,518 | B2 | 1/2006 | Chou | |
| 7,128,454 | B2 | 10/2006 | Kim | |
| 7,150,553 | B2 | 12/2006 | English | |
| 7,196,358 | B1 | 3/2007 | Chen | |
| 7,490,959 | B2 | 2/2009 | Tsuda | |
| 7,588,351 | B2 | 9/2009 | Meyer | |
| 7,726,858 | B2 | 6/2010 | Sato | |
| 2002/0113244 | A1 | 8/2002 | Barnett | |
| 2003/0031032 | A1 | 2/2003 | Wu | |
| 2003/0117797 | A1 | 6/2003 | Sommers | |
| 2004/0095738 | A1 | 5/2004 | Juang | |
| 2004/0201025 | A1 | 5/2004 | Barnett | |
| 2004/0264196 | A1 | 12/2004 | Shu | |
| 2005/0007772 | A1 | 1/2005 | Yen | |
| 2005/0174780 | A1 | 8/2005 | Park | |
| 2005/0194607 | A1 | 9/2005 | Barnett | |
| 2005/0243550 | A1 | 11/2005 | Stekelenburg | |
| 2005/0254246 | A1 | 11/2005 | Huang | |
| 2006/0092637 | A1 * | 5/2006 | Yeh | 362/249 |
| 2006/0138440 | A1 | 6/2006 | Jyo | |
| 2006/0232974 | A1 | 10/2006 | Lee | |
| 2007/0236935 | A1 | 10/2007 | Wang | |
| 2007/0253202 | A1 | 11/2007 | Wu | |
| 2008/0105886 | A1 | 5/2008 | Borner | |
| 2008/0197374 | A1 | 8/2008 | Sung | |

OTHER PUBLICATIONS

US Pending Patent Application, U.S. Appl. No. 11/938,131, Office Action dated Mar. 11, 2010.

US Pending Patent Application, U.S. Appl. No. 12/296,274, Office Action dated Jan. 6, 2011.

US Pending Patent Application, U.S. Appl. No. 11/938,131, Office Action dated Nov. 26, 2010.

PCT Application, Serial No. PCT/US2007/065995, Written Opinion of the International Searching Authority, Jun. 20, 2008.

* cited by examiner

Comparison of Incandescent Light Bulb efficiency by wattage (120 Volt lamps)

| Power (W) | Output (lm) | Efficiency (lm/W) |
|---|---|---|
| 5 | 25 | 5 |
| 15 | 110 | 7.3 |
| 25 | 200 | 8.0 |
| 35 | 350 | 10.3 |
| 40 | 500 | 12.5 |
| 50 | 700 | 13.5 |
| 55 | 800 | 14.2 |
| 60 | 850 | 14.5 |
| 65 | 1000 | 15.0 |
| 70 | 1100 | 15.7 |
| 75 | 1200 | 16.0 |
| 90 | 1450 | 16.1 |
| 95 | 1600 | 16.8 |
| 100 | 1700 | 17.0 |
| 135 | 2350 | 17.4 |
| 150 | 2850 | 19.0 |
| 200 | 3900 | 19.5 |
| 300 | 6200 | 20.7 |

FIG. 10

Prior Art

LED LIGHTING DEVICE

FIELD OF THE INVENTION

The present invention relates to the field of environmental illumination and more particularly relates to a light bulb substitute utilizing high-flux LEDs as a light source.

BACKGROUND OF THE INVENTION

Environmental lighting is a paramount concern for people. With lighting, individuals can "extend" the day so they can be more productive. They can enhance certain moods of being for themselves and others. They can see in places normally darkened. Lighting has become a necessity in modern society. To this end, mankind had developed new and more efficient ways of creating environmental lighting since the discovery of fire. Perhaps the most innovative improvement at the time was Edison's incandescent lamp, which has formed the basis for lighting for the past century.

Improvements in lighting have utilized new technologies. Fluorescent lighting has recently become more affordable and more convenient, adapting the technology to work with the standard "Edison" light sockets to power new compact fluorescent devices. However, fluorescent devices contain mercury, which is released into the immediately surrounding environment when a fluorescent bulb is broken and can be an immediate and direct health and environmental hazard. They also use more energy than LED's.

LED's have not, until now, been extensively used due to their relatively low (compared to incandescent, fluorescent and halogen bulbs) light output and lack of white light. Likewise, while they generate less heat than a conventional incandescent bulb, LED's are extremely sensitive to heat, even the lower levels they themselves generate—which affects their performance. Currently, high-flux LED's have been introduced to the market, such as the DYNASTY high-flux LED produced by CAO Group, Inc., and offer more promise in the environmental lighting market than conventional LEDs.

The present invention is a base that is capable of being inserted in a standard Edison socket, upon which is mounted at least one high-flux LED. The base contains control circuitry in order to operate the LEDs and acts as a dissipative heat sink. The high-flux LEDs are removable in case of eventual burn-out or a simple desire of the user to change colors of the light. The present invention represents a departure from the prior art in that the environmental lighting of the present invention allows for the efficient use of LED's in a cost and energy efficient lighting design.

SUMMARY OF THE INVENTION

In view of the foregoing disadvantages inherent in the known types of lighting devices, this invention provides an environmental lighting device. As such, the present invention's general purpose is to provide a new and improved lighting device that utilizes high-flux LED's in a manner that is more efficient and environmentally friendly than other lighting strategies.

To accomplish these objectives, the lighting device comprises a body doubling as a heat sink. One end is configured to fit inside and draw power from a standard Edison socket. Another end is configured with at least one port for receiving high-flux LED's. Contained within the body is control circuitry to regulate the LED's. The body may also be configured with heat dissipating geometry and with faceting on the end with the LED's so as to better focus or distribute light.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 10 is a table displaying wattage to light output for 120V incandescent lamps.

DETAILED DESCRIPTION OF THE INVENTION

Figure 3:
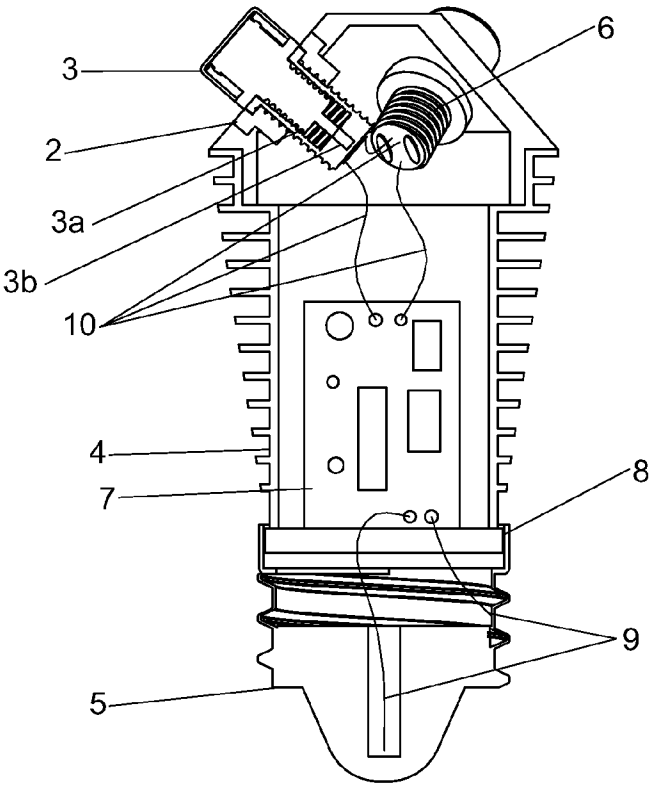
FIG. 3 is a cross-sectional view of the lighting device of FIG. 1, taken along line B-B.
Figure 1:
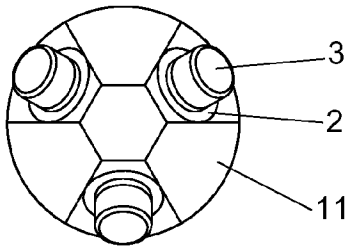
FIG. 1 is a side plan view of a lighting device depicting one embodiment of the invention.

With reference to FIGS. 1-4, the lighting device comprises a main body 4 with a screw-base interface 5 and a top cap 1. An insulative washer insert 8 is positioned between the main body 4 and the screw-base interface 5 so as to electrically isolate these pieces from each other. Contained within the main body 4 is a control circuit board 7. As noted in the figures, the LED's 3 are a threaded, screw-in variety and are inserted into sockets in the top cap 1. It should be noted that certain high-flux LED's may now consume 3 W, yet emit 200 lumens, approximately the same output as a 25 W incandescent light bulb. Therefore, the use of 3 such LED's, as shown in the figures, would emit 600 lumens and would be the equivalent of approximately a 45 W incandescent light bulb. Each additional 3 W high flux LED would add 200 lumens and approximate an incandescent light bulb of varying wattages according to the table shown in FIG. 10 (4 for 800 lumens, approximately equivalent to a 55 W incandescent bulb, 6 for 75 W, etc.). Heat concerns for LED's are significant, even given the lesser heat emitted by an LED as opposed to an incandescent light bulb, as heat can diminish efficiency and shorten LED lifespan. Balance is achieved by increasing the heat sink capabilities of the main body 4 and providing heat dissipative geometry, notably the fins 12 on the main body 4, to discourage overheating. Any geometry that would increase surface area (and thus contact with air) would tend to help in the dissipation of heat. The parallel fins 12 depicted are just one example of such geometry and are not to be deemed as limiting.

Figure 2:
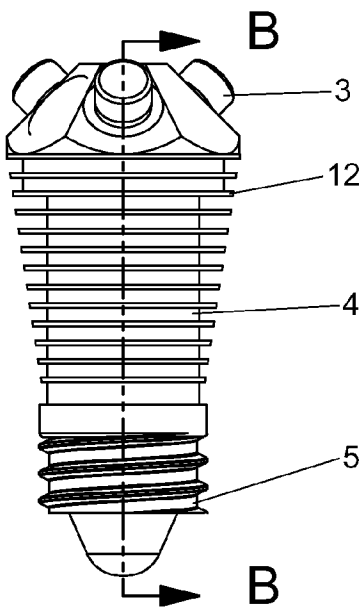
FIG. 2 is a top plan view of the lighting device of FIG. 1.
Figure 4:
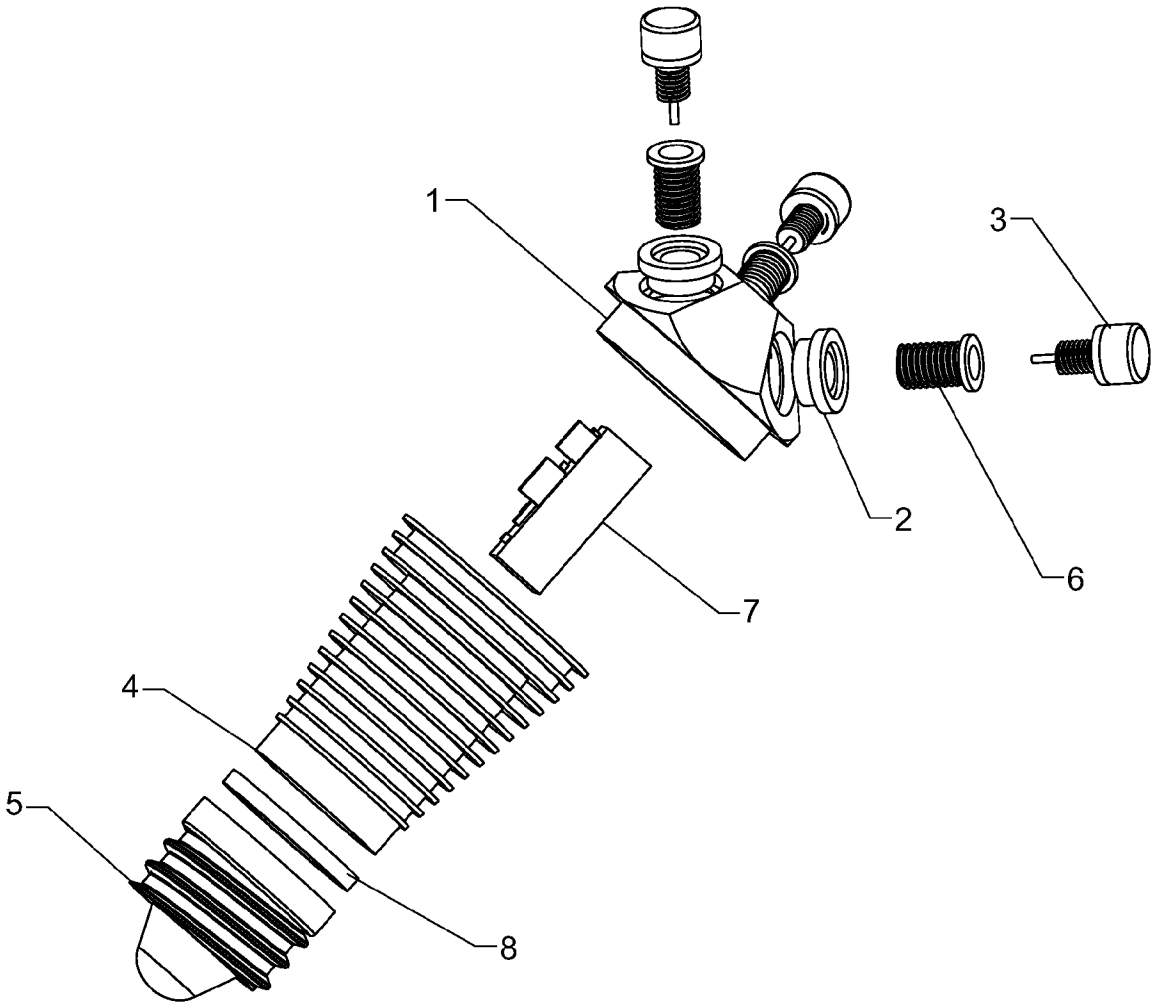
FIG. 4 is an exploded view of the lighting device of FIG. 1.
Figure 7:
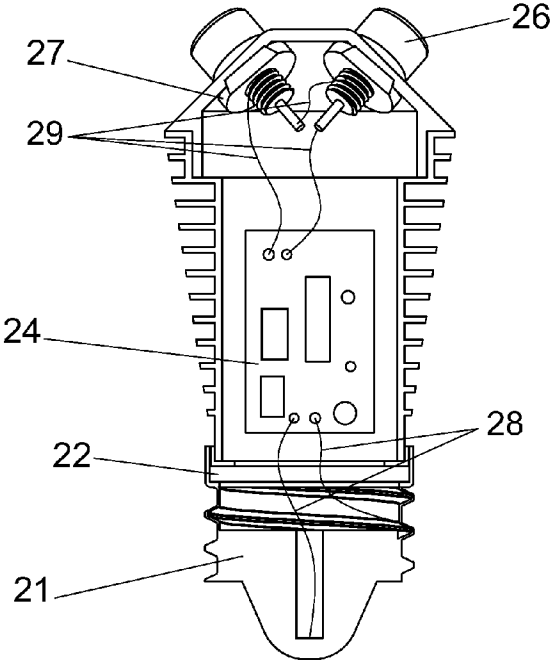
FIG. 7 is a cross-sectional view of the lighting device of FIG. 5, taken along line A-A.
Figure 5:
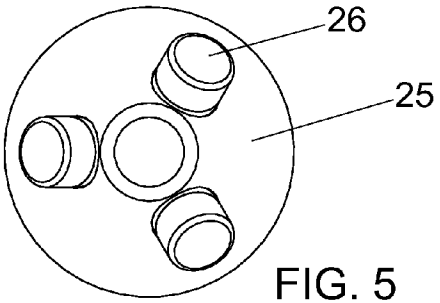
FIG. 5 is a side plan view of a lighting device depicting another embodiment of the invention.
Figure 6:
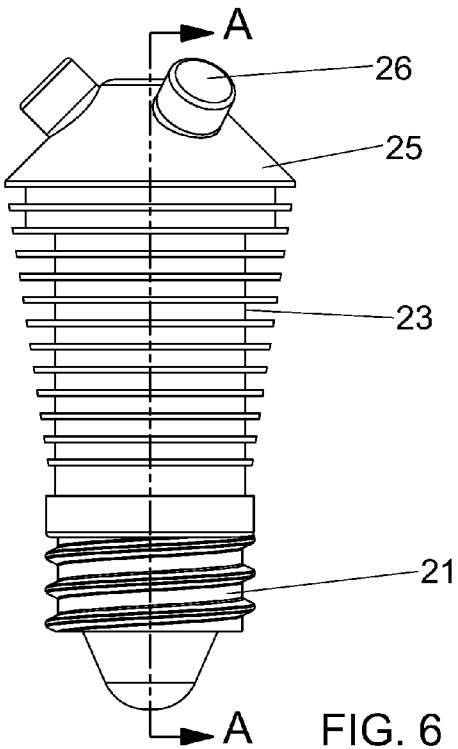
FIG. 6 is a top plan view of the lighting device of FIG. 5.
Figure 9:
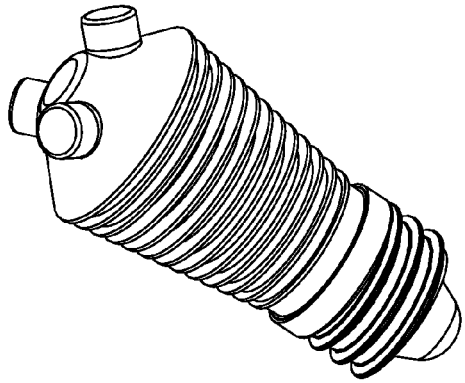
FIG. 9 is a perspective view of the lighting device of FIG. 5.
Figure 8:
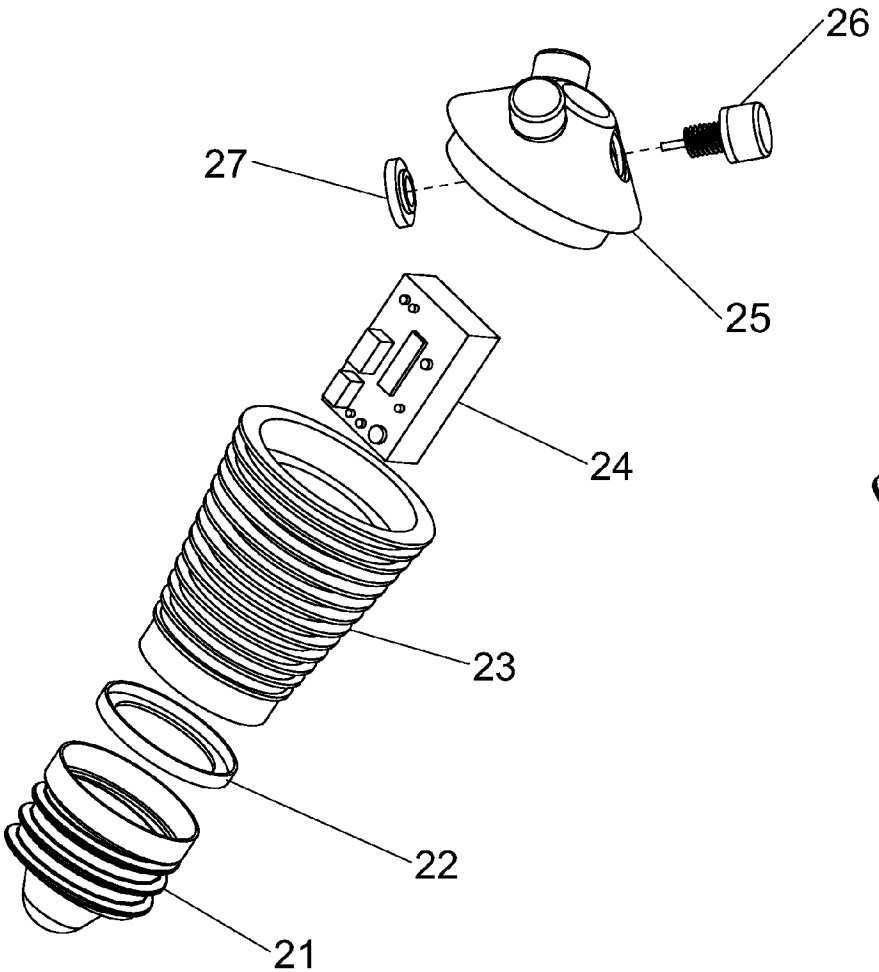
FIG. 8 is an exploded view of the lighting device of FIG. 5.

The socket structure for the embodiment depicted in FIGS. 1-4 comprises an insert 2 that lines the holes in the top cap and a socket base 6 residing in each insert 2. Connections, shown in FIG. 3, between the circuit board 7 and the socket bases 6 are made with wires 10. Circuit board 7 is connected to screw-base interface with wires 9. Power is then transmitted from the screw-in socket to the screw-base of the lighting device 5 and to the circuit board 7, which then configures and sends the power for use by the LEDs 3. As can be seen in FIG. 2, the top cap 1 is faceted 11 to aid in light dispersion. Different facet shapes and polishes may be used to create lighting effects according to what is known in the art. It should also be noted that the LED's 3 are removable and, therefore, replaceable. LED's 3 may be removed in the event of failure or based upon the desires of a consumer who may want a different color of LED utilized.

A second embodiment is shown in FIGS. 5-9. Like the first embodiment, the second embodiment features three LED's 26 inserted in the top cap 25, which is mounted on the main body 22, which is in turn mounted on a screw base 21 with an insulative washer 22. Circuit board 24 is contained within the main body 23 and is electrically connected to the screw base 21 through wires 28. With this embodiment, LED's 26 are secured with threaded washers 27 and are connected to the circuit board with wires 29. As the LED's 26 are directly connected to the circuit board 24 and each other, this embodiment is designed to be disposable as a unit and does not allow replacement of the LED's 26. The top cap 25 is also polished, with no facets. This is merely to depict a second option of finishing and is not intrinsic to this one embodiment.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A lighting device having a plurality of replaceable LEDs, comprising:

a heat dissipating body having a first end and a second end spaced from the first end;

a screw-base interface configured for attachment to the first end of the heat dissipating body and further configured to attach to and receive electrical power from a standard Edison-type socket;

an electrically insulative member positioned between the screw-base and the first end of the heat dissipating body;

a cap member having an outer surface extending between a base region and a second region spaced from the base region, the base region being configured for attachment to the second end of the dissipative body, the cap member having a plurality of apertures spaced about the outer surface;

a plurality of inserts, one insert positioned within each aperture and configured to receive a socket base;

a plurality of socket bases, one socket base positioned within each insert; and a plurality of LEDs, one LED removably threaded into each socket base, wherein each LED includes a threaded base sized and configured for being received through a corresponding one of the plurality of socket bases and wherein the lighting device further comprises a plurality of threaded nuts, each nut sized and configured for removable attachment to the threaded base of a corresponding one of the plurality of LEDs.

2. The lighting device of claim 1, further comprising a circuit board configured to receive alternating current from the screw-base and provide direct current to the plurality of LEDs.

3. The lighting device of claim 1, wherein the heat dissipating body comprises a cylindrical outer surface and a plurality of cooling fins spaced on the cylindrical outer surface.

4. The lighting device of claim 1, further comprising three sets of apertures, inserts, socket bases and LEDs grouped together and spaced equally about the outer surface of the cap member.

5. A lighting device having a plurality of replaceable LEDs, comprising:

a heat dissipating body having a first end and a second end spaced from the first end;

a screw-base configured for attachment to the first end of the heat dissipating body and further configured to attach to and receive electrical power from an electric socket;

a cap member having an outer surface extending between a base region and a second region spaced from the base region, the base region being configured for attachment to the second end of the dissipative body, the cap member having a plurality of apertures spaced about the outer surface;

a plurality of inserts, one insert positioned within each aperture and configured to receive a socket base;

a plurality of socket bases, one socket base positioned within each insert; and a plurality of LEDs, one LED removably positioned into each socket base, wherein each LED includes a threaded base sized and configured for being received through a corresponding one of the plurality of socket bases and wherein the lighting device further comprises a plurality of threaded nuts, each nut sized and configured for removable attachment to the threaded base of a corresponding one of the plurality of LEDs.

6. The lighting device of claim 5, further comprising an electrically insulative member positioned between the screw-base and the first end of the heat dissipating body.

7. The lighting device of claim 5, wherein each LED includes a threaded base sized and configured for threading attachment to a corresponding one of the plurality of socket bases.

8. The lighting device of claim 5, wherein the heat dissipating body comprises a cylindrical outer surface and a plurality of cooling fins spaced on the cylindrical outer surface.

9. The lighting device of claim 8, further comprising three sets of apertures, inserts, socket bases and LEDs grouped together and spaced equally about the outer surface of the cap member.

10. The lighting device of claim 9, wherein the cap member includes three facets and wherein each set of apertures, inserts, socket bases and LEDs is positioned on a corresponding one of the facets.

11. The lighting device of claim 1, wherein the cap member is removably attached to the heat dissipating body.

12. The lighting device of claim 5, wherein the cap member is removably attached to the heat dissipating body.

13. The lighting device of claim 1, wherein the outer surface of the cap member is a substantially cone/conical shape that is truncated, starting from the base region and tapering toward the second region.

14. The lighting device of claim 5, wherein the outer surface of the cap member is a substantially cone/conical shape that is truncated, starting from the base region and tapering toward the second region.

15. A lighting device having a plurality of replaceable LEDs, comprising:

a cylindrical shaped heat dissipating body having a first end and a second end spaced from the first end, the heat dissipating body having a plurality of cooling fins extending outwardly in radial direction between the first and second ends;

a screw-base interface attached to the first end of the heat dissipating body and configured to attach to and receive electrical power from a standard Edison-type socket;

an electrically insulative member positioned between the screw-base and the first end of the heat dissipating body;

a cap member having a substantially cone/conical shaped outer surface that is truncated extending between a base region and a second region spaced from the base region, the base region being attached to the second end of the dissipative body, the cap member having a plurality of apertures spaced about the outer surface;

a plurality of inserts, one insert positioned within each aperture;

a plurality of socket bases, one socket base positioned within each insert;

a plurality of LEDs, one LED removably threaded into each socket base; and a circuit board positioned within the heat dissipating body and configured to receive alternating current from the screw-base and provide direct current to the plurality of LEDs, wherein each LED includes a threaded base sized and configured for being received through a corresponding one of the plurality of socket bases and wherein the lighting device further comprises a plurality of threaded nuts, each nut sized and configured for removable attachment to the threaded base of a corresponding one of the plurality of LEDs.

16. The lighting device of claim 15, further comprising three sets of apertures, inserts, socket bases and LEDs grouped together and spaced equally about the outer surface of the cap member.

17. The lighting device of claim 16, wherein the cap member includes three facets and wherein each set of apertures, inserts, socket bases and LEDs is positioned on a corresponding one of the facets.

* * * * *